United States Patent [19]

Castoe

[11] 4,095,494

[45] Jun. 20, 1978

[54] GEAR-OPERATED RATCHET WRENCH

[76] Inventor: John H. Castoe, 10234 McVine St., Sunland, Calif. 91040

[21] Appl. No.: 787,082

[22] Filed: Apr. 13, 1977

[51] Int. Cl.[2] ..... B25B 13/46

[52] U.S. Cl. ..... 81/63.2; 81/90 C; 81/177.8

[58] Field of Search ..... 81/60, 63.2, 177 R, 81/177 ST, 177.9, 177.8

[56] References Cited

U.S. PATENT DOCUMENTS

| | | | |
|---|---|---|---|
| 2,758,493 | 8/1956 | Goldwater | 81/60 |
| 2,982,162 | 5/1961 | Golden | 81/60 |
| 3,186,265 | 6/1965 | Wenturine et al. | 81/177.9 |
| 3,383,962 | 5/1968 | Harris | 81/177.9 |

FOREIGN PATENT DOCUMENTS

| | | | |
|---|---|---|---|
| 1,295,729 | 5/1962 | France | 81/52.29 |
| 589,794 | 6/1947 | United Kingdom | 81/177 B |

*Primary Examiner*—James L. Jones, Jr.
*Attorney, Agent, or Firm*—Christie, Parker & Hale

[57] ABSTRACT

A wrench for working in areas of greatly limited access includes a head having a bore extending through it, a handle secured to the head, a socket for engagement with an object to be rotated, and gear teeth spaced apart circumferentially around the outside surface of the socket. The head is split and hinged to pivot between an open position for expanding the effective size of the bore and a closed position for extending around the gear teeth of the socket when the latter is inserted in the bore. A spring-biased locking mechanism locks the hinged portion of the head in its closed position during use. The locking mechanism is releasable to allow the head to pivot to its open position. A reversible ratchet pawl engages the gear teeth to provide reversible, unidirectional rotation of the socket relative to the head.

27 Claims, 11 Drawing Figures

195
195b
198
195a
199
197
196
112
150
164
6
6
110
118
124
192
122
130
128
142
126
137
18

166
168
164
276
150

202
206
274
276
250
208
204

374
350
376

GEAR-OPERATED RATCHET WRENCH

BACKGROUND

This invention relates to wrenches, and more particularly to a gear-operated ratchet wrench capable of working in areas of greatly limited access.

Automobile mechanics commonly are required to tighten or remove a nut or bolt located in an area of limited access. Working space is often restricted in front-end work, or when working on automobile engines having space restrictions because of auxiliary equipment such as smog devices, air-conditioners, and the like. These problems are compounded when loosening a bolt, nut, tie-rod sleeve, or the like which is frozen in place.

A conventional ratchet wrench includes a socket for being releasably secured to a rotatable, ratchet-operated projection carried on the head of the wrench. The socket fits over the end of a bolt or nut to be tightened or loosened. In many instances, space restrictions prevent the mechanic from fitting such a ratchet wrench and socket over the end of the nut or bolt. In other instances, the conventional ratchet wrench may fit over the end of a nut or bolt, but there will not be sufficient room to back up the socket wrench as the nut or bolt is being loosened.

A common problem faced by the front-end mechanic is to rotate a tie-rod sleeve to adjust the length of the tie-rod which, in turn, controls the toe-in setting. Many tools do not allow the tie-rod sleeve to be rotated without removing at least a portion of the tie-rod. Other tools which can fit around the tie-rod sleeve apply pressure which tends to make it more difficult to rotate the sleeve.

The present invention overcomes these problems by providing a reversible ratchet wrench and socket which can be applied to a nut or bolt and remain in the same plane as the nut or bolt when they are being tightened or loosened. Therefore, the wrench requires a minimum of space and as a result, it can be used to loosen or tighten a nut or bolt in many situations where the conventional ratchet wrench and socket would be unable to do so. Further, the wrench of this invention provides a ratchet which can be reversed without having to remove the wrench from the nut or bolt, which minimizes the amount of time required to use the wrench in a given job.

SUMMARY OF THE INVENTION

Briefly, the invention comprises a gear-operated ratchet wrench having a body having a bore through it, an elongated handle secured to the body for rotating the body about an axis through the bore, and a socket releasably secured in the bore. The socket has circumferentially spaced apart gear teeth disposed in the bore for allowing the socket to be positioned within the plane of the bore, if desired. A ratchet pawl extends into releasable engagement with the socket gear teeth to provide reversible, unidirectional rotation of the socket relative to the body.

In a preferred form of the invention, hinge means are provided for rotating the body between an open position and a closed position so as to expand the effective size of the bore through the body. This allows the socket to be inserted in the bore from a direction lateral to the socket. The body is releasably secured in its closed position to hold the socket in the bore through the body. Owing to the body of the wrench being engaged with the socket laterally with respect to the socket, the amount of working space required for the wrench is reduced when compared with a conventional wrench requiring the socket to fit over the end of a nut or bolt to be rotated by the wrench.

In one form of the invention, the socket can be hinged to pivot between an open position which expands the effective size of the socket opening. This enables the socket to be attached to a nut or bolt from a position lateral to the bolt, as opposed to being placed over the end of the nut or bolt. This facilitates use of the wrench in situations involving extremely limited space restrictions.

These and other aspects of the invention will be more fully understood by referring to the following detailed description and the accompanying drawings.

DRAWINGS

DETAILED DESCRIPTION

Figures 1, 2, 3, 4:
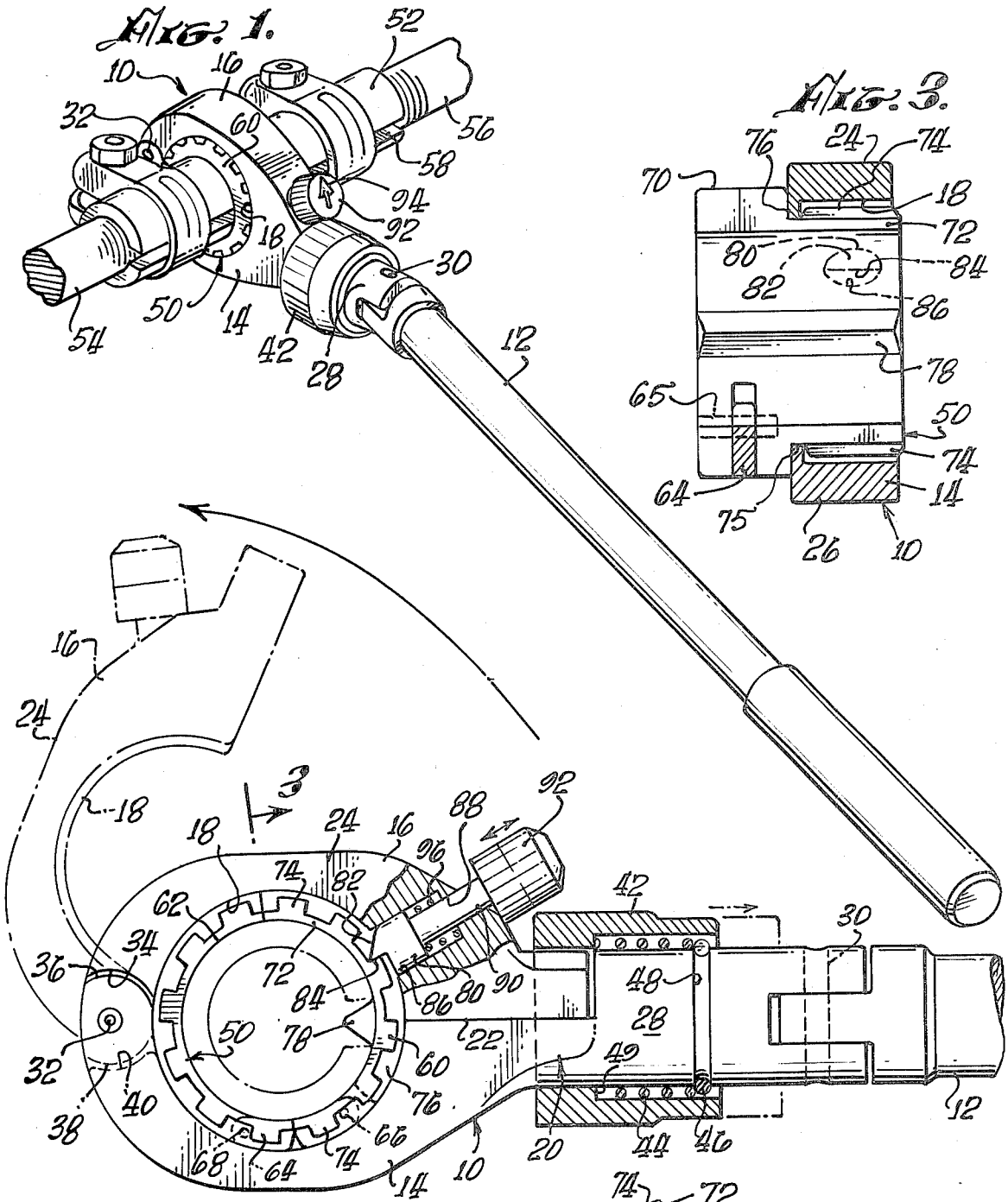
FIG. 1 is a fragmentary perspective view showing one embodiment of a gear-operated ratchet wrench according to this invention.
FIG. 2 is a fragmentary elevation view, partly in cross-section and partly broken away, showing the head portion of the wrench shown in FIG. 1.
FIG. 3 is a cross-sectional elevation view taken on line 3—3 of FIG. 2.
FIG. 4 is a perspective view showing the hinged socket of FIGS. 1 through 3 in its hinged open position.

Referring to FIGS. 1 through 4, a gear-operated ratchet wrench according to this invention includes a wrench head or body 10 pivotally connected to one end of an elongated handle 12. The wrench head has a rounded main body with opposite flat faces 14 and 16 and a bore 18 extending between the opposite faces of the head. A necked-down portion 20 of the head 10 (see FIG. 2) extends between the bore 18 and the handle 12. The necked-down portion 20 is split along a line at 22 so that a half 24 of the wrench is movable and the remaining half 26 is fixed. The fixed half 26 is rigidly secured to a shank portion 28 of the handle. The fixed half is shown as an integral portion of the shank, but the shank also can be secured to the fixed portion by screw threads, or the like. The shank 28 is pivotally secured to the handle 12 by a pivot pin 30 which enables the shank and the head to pivot relative to the handle 12 about a transverse axis through the pivot pin, the transverse axis being spaced from and perpendicular to the axis through the bore 18 of the wrench head 10.

A hinge pin 32 pivots the movable half 24 of the head 10 to the fixed half 26 on the side of the bore 18 remote from the handle 12. The hinged portion of the head is split to define a rounded edge 34 on the movable half 24 spaced closely from a correspondingly-shaped rounded edge 36 on the fixed half 26. A nose 38 projects away from the movable half 24 into a recess 40 in the fixed half 26. The hinge pin 32 extends through the recess and the nose 38 to hinge the movable half 24 to the fixed half 26. This allows the movable half 24 to pivot relative to the fixed half 26 so as to move to an open position shown in phantom lines in FIG. 2. In the open position, the effective size of the bore 18 is expanded relative to its normal size defined by its closed position shown in solid lines in FIG. 2.

A locking mechanism releasably holds the movable half 24 in its closed position. The locking mechanism includes a sleeve 42 disposed around the shank 28. The sleeve slides longitudinally into and out of engagement with the necked-down portion 20 of the head 10. The sleeve 42 is normally spring-biased into a locking position shown in solid lines in FIG. 2. The sleeve 42 is biased into the locked position by a coil spring 44 disposed around the outer surface of the shank 28. An O-ring 46 is seated in a recess 48 in the shank. The O-ring holds the coil spring 44 in a fixed position around the shank 28 and allows the spring to normally urge the sleeve 42 into engagement with a shoulder 50 inside the sleeve 42. The normal bias of the spring 44 holds the sleeve 42 in its locked position securing the movable half 24 of the head in its closed position during use.

The sleeve 42 is manually slidable against the bias of the spring 44 to a released position illustrated in phantom lines in FIG. 2. In the released position, the movable half 24 of the head is free to rotate to its open position.

The wrench thus far described is adapted to operate a variety of sockets for engaging any of a number of different objects to be rotated by the wrench. The wrench shown in FIGS. 1 through 4 is used with a gear-operated hinged socket 50 for rotating a tie-rod sleeve 52. The tie-rod sleeve 52 is a component of a turnbuckle assembly used in a tie-rod of a front-end suspension system. The tie-rod sleeve 52 is internally threaded and engaged with external threads on a pair of collinear tie-rod members 54 and 56. The tie-rod sleeve 58 has a longitudinal split 58 extending from end-to-end of the sleeve. When the tie-rod sleeve 52 is turned in one direction, the effective length of the tie-rod, i.e., the combined tie-rod members 54 and 56, is shortened; whereas turning the tie-rod sleeve 52 in the opposite direction increases the effective length of the tie-rod. The effective length of the tie-rod controls the toe-in setting of the front-end suspension system.

Known prior art tools for rotating the tie-rod sleeve 52 are often subject to interference with nearby frame cross-members because of their inability to be used in areas of greatly limited access; and such prior art tools often are not able to reverse the direction of rotation of the sleeve without requiring the mechanic to remove the tool to reverse it before the sleeve can be turned in the opposite direction. Some prior art tools capable of turning the tie-rod sleeve 52 are used by applying pressure radially inwardly on the sleeve to grip the sleeve to rotate it. This tends to close the sleeve along the split 58 which increases the sleeve's grip on the tie-rod members 54, 56, making it even more difficult to rotate the sleeve, which can be virtually impossible if the sleeve is frozen on the tie-rod members 54, 56.

These problem are overcome by the hinged gear-operated socket 50 which includes a pair of semi-circular segments 60 and 62 hinged together by a link 64 and a pair of spaced apart hinge pins 66 and 68. The segments 60, 62 rotate between an open position shown in FIG. 4 and a closed position shown in FIG. 2. In its closed position, the outer surface of the socket 50 has an enlarged portion 70 having a smooth outer surface which is stepped down to a portion 72 having a smaller outside diameter with circumferentially spaced apart radially outwardly projecting gear teeth 74 extending around the socket. The gear teeth are long and narrow, and the lengthwise extent of the gear teeth is generally parallel to the axis through the opening in the closed socket 50. The inner ends of the gear teeth stop short of the enlarged portion 70 of the socket to define a circular groove 75 extending around the outer surface of the socket adjacent the gear teeth. An inwardly projecting circular flange 76 extends around the bore 18 through the body 10. When the body is moved to its closed position, the flange 76 interlocks with the groove 75 (see FIG. 3) to hold the socket 50 in the bore 18 of the wrench.

The opening in the socket 50 has a narrow, elongated, inwardly projecting shoulder 78 extending generally parallel to the axis of the bore 18 through the socket. The shoulder 78 is shaped to fit into the split 58 in the tie-rod sleeve 52 (see FIG. 2) when the socket 50 surrounds the outer surface of the sleeve.

The wrench includes a reversible ratchet which enables the wrench to be rotated in either direction to loosen or tighten a nut or bolt without requiring the wrench to be removed. The reversible ratchet includes a ratchet pawl 80 having an angled cam surface 82 and a flat ratchet tooth 84. The ratchet pawl 80 is slidably disposed in an elongated radially extending passage extending through the wrench head 10. The passage includes an enlarged bore 86 which opens into the bore 18 in the head 10. The enlarged bore 86 is stepped down to form a narrow bore 88 which opens through the outer edge of the head 10. The pawl 80 has an elongated extension 90 of reduced diameter extending through the narrow bore 88 beyond the outside edge of the head where a knob 92 is attached to the outer end of the extension 90. The knob is indexed, such as with an arrow 94, to indicate adjustments in the rotational setting of the ratchet pawl 80. The ratchet pawl 80 matches the inside diameter of the enlarged bore 86 and slides longitudinally in that bore in response to the bias of the coil spring 96. The coil spring surrounds the extension 90 and normally urges the ratchet pawl 80 into the bore 18 for spring-biased engagement with the gear teeth 74 of the socket 50.

The use of the socket 50 is best understood by referring to FIG. 1 which illustrates its use with the tie-rod sleeve 52. The preferred use is to initially separate the hinged socket 50 from the wrench and to pivot the socket 50 to its open position (shown in FIG. 4). The opened socket is then placed around the outer surface of the tie-rod sleeve 52, with the shoulder 78 being located in the split 58 in the sleeve. The hinged socket 50 is then closed so as to tightly surround the outer surface of the sleeve 52. The movable half 24 of the wrench head 10 is then released from engagement with the sleeve 42 and rotated to its open position. The opened wrench head is then slipped around the outer surface of the closed socket 50 and the sleeve 42 is moved to its retracted position, allowing the movable half 24 of the wrench head to be closed around the socket 50, with the flange 76 fitting into the groove 75, after which the sleeve 42 is moved back to its locked position to hold the wrench head 10 tightly around the closed socket 50.

The ratchet pawl 80 is then rotated on its axis by turning the knob 92 to the position which controls the desired direction of rotation of the wrench and socket. The ratchet tooth 84 engages one of the gear teeth 74 and prevents rotation of the socket 50 relative to the head 10 as the wrench is being rotated to rotate the tie-rod sleeve 52. The angled cam surface 82 allows the pawl 80 to move against the bias of the spring 96 which, in turn, allows the head to be rotated in the opposite direction relative to the socket and gear teeth. This enables the user to back up the wrench in preparation for further tightening or loosening of the sleeve 52 without removing the wrench. To reverse rotation of the wrench, the ratchet pawl 80 is rotated on its axis by the knob 92. This reverses the direction in which the head 10 can be rotated to rotate the tie-rod sleeve 52 and also reverses the direction of relative rotation between the head 10 and the socket 50.

Figure 5:
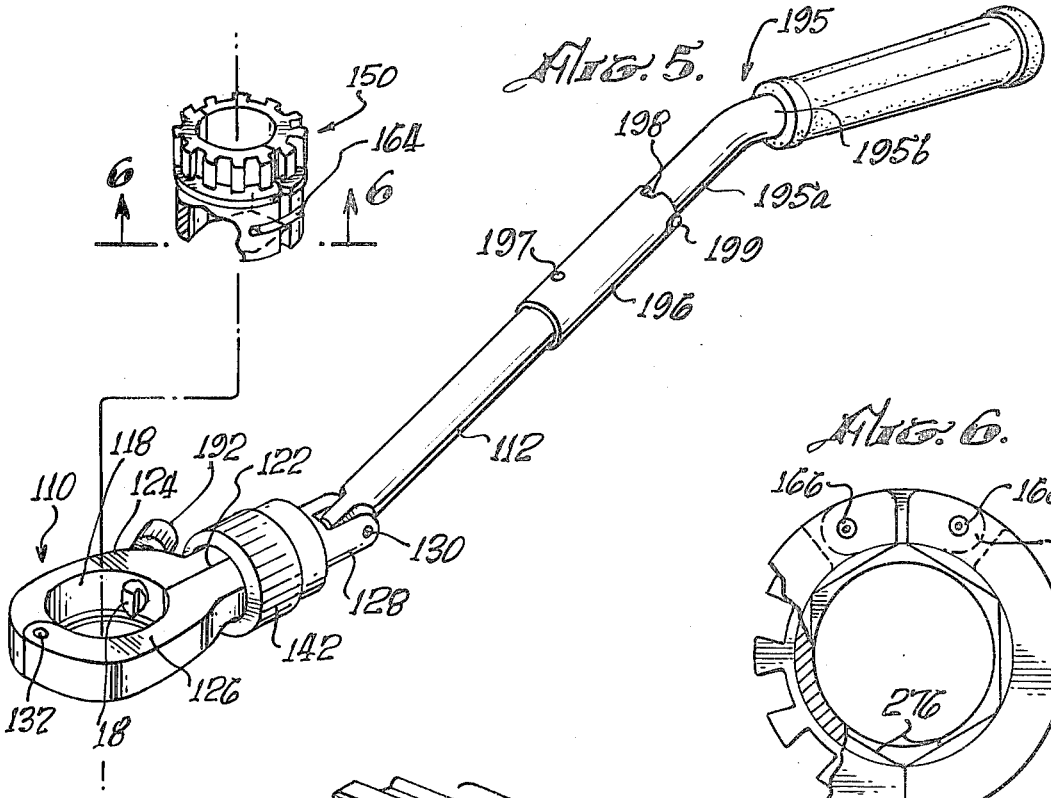
FIG. 5 is an exploded perspective view showing an alternate embodiment of a gear-operated ratchet wrench according to this invention.
Figure 6:
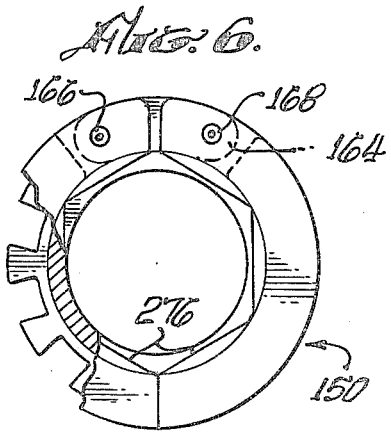
FIG. 6 is an elevation view, partly broken away and partly in cross-section, taken on line 6—6 of FIG. 5 and showing a hinged socket for use in the wrench shown in either FIG. 1 or FIG. 5.

FIGS. 5 through 8 illustrate an alternate form of the gear-operated ratchet wrench and socket. The head 110 of the wrench illustrated in FIG. 5 is substantially identical in structure and function to the wrench head 10. That is, the wrench head 110 is hinged by a hinge pin 132 and split at its base along a line 122 to provide a movable half 124 which opens relative to a fixed half 126 to expand the effective size of the bore 118. The wrench head 110 also includes a spring-biased movable sleeve 142 which surrounds the necked-down base of the wrench to lock the wrench head in its closed position. The sleeve 142 moves against the bias of a spring (not shown, but identical to spring 44), to a released position allowing the movable half 124 of the head to open relative to the remaining portion of the head 110. The wrench head 110 further includes a ratchet pawl 180 identical in structure and function to the ratchet pawl 80 described above. The ratchet pawl 180 is turned on its axis by a knob 192 to reverse the unidirectional rotation of the wrench head relative to the socket.

The handle of the wrench shown in FIG. 5 is an alternate embodiment of the handle 12 shown in FIG. 1. The handle 12 is a type of swivel handle which is especially useful in adjusting tie-rod sleeves. That is, the handle 12 can swivel about the pivot pin 30, i.e., about a transverse axis spaced from and perpendicular to the axis of rotation of the wrench. Thus, the handle can be moved into a position generally parallel to and relatively closely spaced from the longitudinal extent of the tie rod. This allows the mechanic to use the wrench within areas of narrow space limitations.

The wrench shown in FIG. 5 has a main handle portion 112 secured to the base of the wrench head in a manner identical to that of the wrench described above. That is, the main portion of the handle 112 is hinged to the wrench head shank 128 by a hinge pin 130 which allows the handle 112 to rotate about an axis spaced from and perpendicular to the axis of rotation of the wrench head 110. The free end of the handle 112 has an adjustable handle 195 rotatably connected to it. The rotatable handle 195 has a straight portion **195*a* in line with the longitudinal axis of the main handle 112, and an angled end portion 195*b* extending at an angle to the axis of the handle 112. An elongated, cylindrical-shaped sleeve 196 is attached to the remote end of the handle 112 by circumferentially spaced apart rivets 197. The sleeve 196 extends beyond the angle of the handle 112. The sleeve 196 has a bore which opens outwardly at the end of the sleeve and receives the straight portion 195*a* of the handle 195. The end portion of the handle 195 which extends into the interior of the sleeve 196 has a protruding alignment pin (not shown) concentric with the axis of the straight portion 195*a*. The alignment pin is slidably disposed in a recess (not shown) concentrically formed in the end of the handle 112. The alignment pin protrudes from a circular flange (not shown) at the end of the handle 195, and a coil spring (not shown) located in the interior of the sleeve 196 is concentrically disposed around the exterior of the handle portion 195*a*. The coil spring extends between the aforesaid flange and shoulder formed at the end of the sleeve 196 so as to normally urge the end of the handle 195 farther into the sleeve 196 toward the handle 112**.

The remote end of the sleeve 196 includes several circumferentially spaced apart detents 198 spaced around the exterior of the handle portion **195*a*. There are four of the detents 198 spaced equidistantly apart around the annular end of the sleeve 196. The handle portion 195*a* includes a dowel pin 199 which protrudes outwardly from opposite sides of the handle. The dowel pin 199 can be releasably fitted into corresponding detents 198, as shown in FIG. 5. The adjustable handle is used by rotating the straight portion 195*a* about the axis of the main handle 112 and the sleeve 196 to position the end 195*b* of the handle in any of several desired orientations. The handle may be released for rotation by pulling on it away from the sleeve 196 to release the dowel pin 199 from engagement with the detents 198. This releases the handle 195 for rotation relative to the sleeve 196. When the end 195*b* of the handle is in its desired orientation, the dowel pin 199 is engaged with its corresponding detents 198. The biasing spring (not shown) in the interior of the sleeve 196 normally applies a biasing force to the end of the handle 195** which locks it in position in the detents.

FIG. 5 also shows a socket 150 which is used with the wrench head 110. The socket 150 is split and hinged by a hinge link 164 to allow the segments 160 and 162 to pivot about the hinge between an open and closed position. Circumferentially spaced apart gear teeth 174 span the outer surface of the socket, and the socket 150 is held in the wrench head by a cooperating shoulder and groove arrangement similar to that described for the wrench and socket shown in FIGS. 1 through 4. The ratchet pawl 189 engages the gear teeth 174 to rotate the socket in a manner akin to that described for the wrench and socket in FIGS. 1 through 4. The internal configuration of the socket 150 can vary, and in the form shown in FIG. 5, the inside surface of the socket has flats 176 for providing a hexagonal-shaped socket for engagement with a hex nut or bolt.

The wrench and socket assembly shown in FIG. 5 provides a versatile tool which is especially useful in removing a nut or bolt located in a very narrow area of access. The tool is useful in instances where the conventional ratchet wrench cannot be fitted over the end of the nut or bolt and then have enough room to loosen the nut or bolt. In use, the hinged segments of the socket 150 are initially rotated to their open position and the socket is then slipped around the outside of the nut or bolt and then closed. The head of the wrench is then opened and fitted around the closed socket, after which the wrench head is closed and the ratchet pawl engaged with the gear teeth 174 of the socket 150. The wrench then can be used to rotate the nut or bolt in the desired direction of rotation. For example, the tool is especially useful in loosening the nut or bolt while leaving the tool in place, and then simply reversing the direction of rotation to tighten the nut or bolt. This not only allows a workman to accomplish a job in an area of very narrow access, but also avoids the inconvenience of having to remove and reapply the wrench in order to change directions of rotation.

Figure 7:
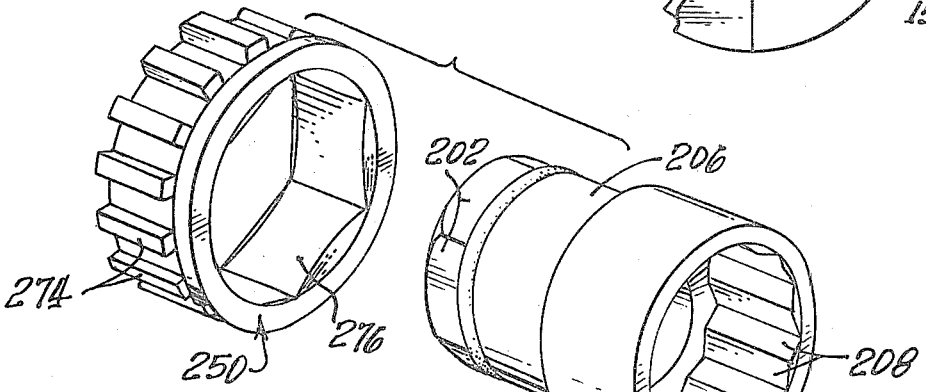
FIG. 7 is an exploded perspective view showing a separate ratchet and socket assembly for use in the wrench shown in either FIG. 1 or FIG. 5.
Figure 8:
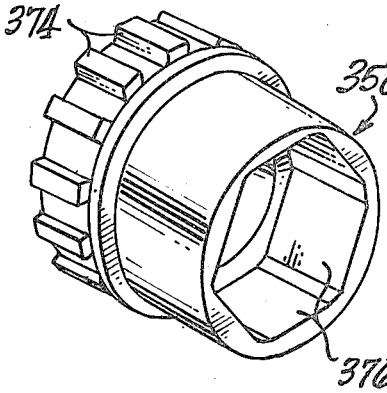
FIG. 8 is a perspective view showing an integral socket and ratchet combination for use in the wrench shown in either FIG. 1 or FIG. 5.

FIGS. 7 and 8 show modified forms of gear-operated sockets capable of use with the wrench of this invention. FIG. 7 shows a non-split socket adapter 250 having spaced apart gear teeth 274 for being engaged with the ratchet pawl of the wrench. The opening through the adapter 250 can have a variety of shapes, such as having hexagonal-shaped flats 276 for cooperating with corresponding hexagonal flats 202 on a socket 204. The socket 204 has an extension 206, and the interior of the socket can have a variety of flat surfaces 208 for engagement with a correspondingly-shaped nut, bolt or other object to be loosened or tightened.

FIG. 8 illustrates a further alternate form of a non-split integral ratchet and socket 350 used with the wrench of this invention. The gear teeth 374 are spaced around a portion of the socket 350 and the internal hexagonal flats 376 of the socket are formed on an extended portion of the socket to place the socket in a laterally extended position with respect to the head of the wrench.

Figure 9:
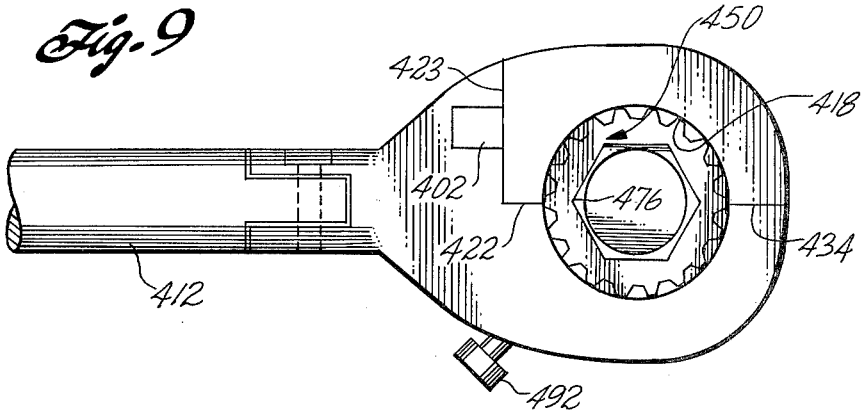
FIG. 9 is a fragmentary elevation view showing an alternate locking mechanism for locking the hinged portion of the wrench.
Figure 10:
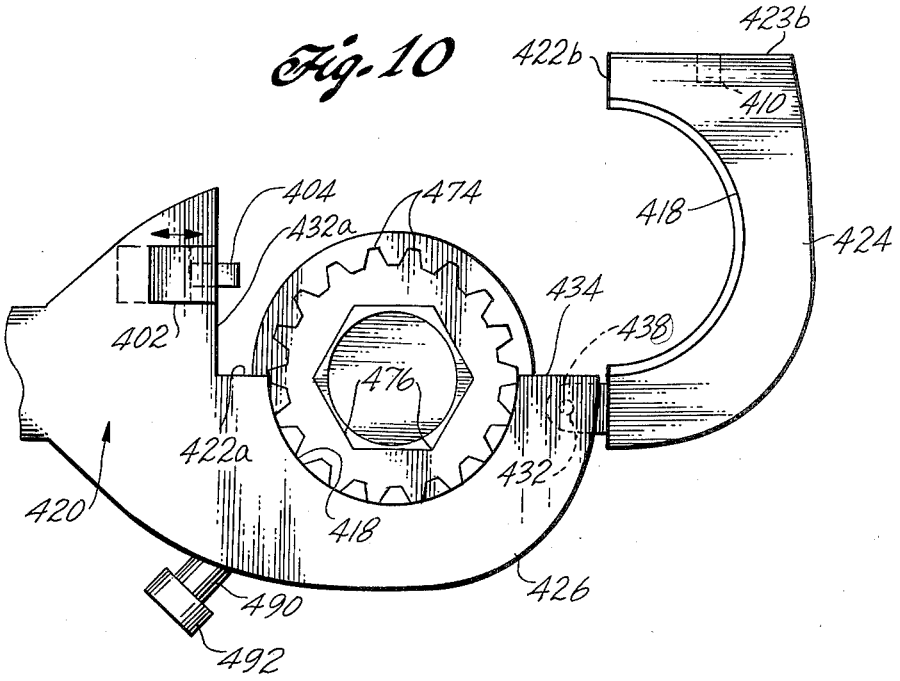
FIG. 10 is a fragmentary elevation view showing the wrench of FIG. 9 in its open position.
Figure 11:
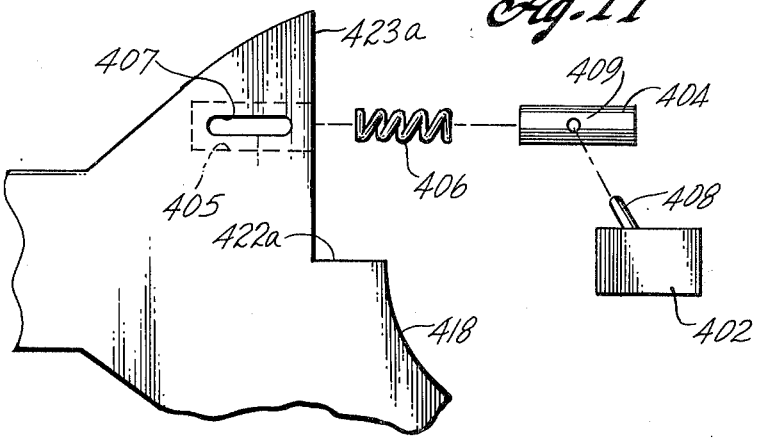
FIG. 11 is a fragmentary exploded elevation view showing the elements of the alternate locking mechanism.

FIGS. 9 through 11 show an alternate means for locking the hinged portion of the wrench head in its closed position. According to this embodiment, the outer portion of the wrench head is split along an axial line 434 extending from the bore 418 to the outer edge of the wrench head. The inner portion of the wrench head is split along lines extending at right angles to each other. The right-angle split comprises an axial split 422 extending away from the bore 418 toward the necked-down portion 420 of the wrench head, and a lateral split 423 extending at a right angle to the axial split 422. The lateral split 423 extends to the edge of the wrench head to divide the wrench head into a fixed portion 426 and a movable portion 424 hinged to the outer edge of the fixed portion by a hinge 438 and hinge pin 432. The movable portion 424 pivots between a closed position shown in FIG. 9 and an open position shown in FIG. 10.

The movable portion 424 is locked in its closed position by a locking mechanism which includes a thumb-operated slidable indexing tab 402 which overlies the portion of the wrench head inboard the surface 423*a*. The indexing tab controls the position of a slidable cylindrical detent 404 which slides back and forth in a cylindrical recess 405 formed in the surface 423*a*. The detent 404 is slidable in and out of the recess 405 by a coil spring 406 disposed in the recess 405. An elongated opening 407 extends through the wall of the wrench head into the recess 405, and the tab 402 has a pin 408 which extends through the opening 407 and makes a tight press-fit in an opening 409 in the side of the detent 404. The coil spring normally urges the detent 404 outwardly to the position shown in solid lines in FIG. 10. In this position the detent 404 protrudes beyond the surface 432*a*. The coil spring 406 urges the pin 408 of the tab 402 against the edge of the opening 407 closest to the surface 423*a* which acts as a stop for the tab. The protruding detent extends into a cylindrical recess 410 in the movable portion 424 when the latter is in its locked position. The protruding detent 404 can be retracted completely into the interior of the recess 405 by sliding the tab toward the left in FIG. 10 against the bias of the coil spring 406.

In use, the movable portion 424 of the wrench head can be moved to its open position shown in FIG. 10 by moving the tab 402 toward the left in FIG. 10 to retract the detent 404 fully into the recess 405. This frees the detent from engagement with the recess 410 and allows the movable portion 424 to move to its open position shown in FIG. 10. To lock the movable portion 424 around the socket 450, the tab 402 is moved against the bias of the coil spring 406 to retract the detent 404, and the movable portion 424 is then pivoted to its closed position shown in FIG. 9. The tab 402 is then released, allowing the biasing spring 406 to urge the detent 404 into the recess 410 in the movable portion 424 of the wrench head.

The locking mechanism shown in FIGS. 9 through 11 enables the wrench of this invention to be used in areas of limited access immediately adjacent the fastener being loosened or tightened by the wrench. For example, the locking sleeve 42 of the wrench shown in FIG. 1 may be too large to enable the wrench to fit into a narrow space adjacent the fastener. The locking mechanism shown in FIGS. 9 through 11 enables the wrench to be used in these situations.

Thus, the invention provides a versatile wrench which can be used in areas of very limited access. The socket and wrench head can be secured around the side of the nut or bolt, rather than going over the ends of them, which can require more space when loosening the nut or bolt. Further, a job of loosening and tightening a nut or bolt can be done without removing the wrench. Further, the wrench can be used in such applications as turning a tie-rod sleeve without having to remove the tie-rod to gain access to it and to turn the tie-rod sleeve in either direction without having to remove the tool to reverse directions.

I claim:

1. A gear-operated ratchet wrench comprising:

a body having an opening in it, the opening having an axis;

an elongated handle secured to the body for rotating the body about said axis;

a socket for being secured to an object to be rotated by the wrench;

hinge means for rotating the body between a closed position and an open position to expand the effective size of the opening in the body to allow the socket means to be inserted in the opening, the body having a fixed portion rigidly affixed to the handle means and a movable portion engaged with the hinge means to rotate relative to the fixed portion;

gear teeth spaced circumferentially around a portion of the socket;

means releasably securing the gear teeth portion of the socket in said opening, the releasable securing means including a movable locking sleeve having a locked position disposed around the fixed portion and the movable portion of the body to hold the body in the closed position, the locking sleeve being movable to a released position allowing the movable portion of the body to rotate relative to the fixed position;

a ratchet pawl extending into engagement with the gear teeth portion of the socket to allow relative rotation between the socket and the body in one direction of rotation and to prevent said rotation in an opposite direction; and means for rotating the ratchet pawl to reverse the direction of relative rotation between the socket and the body.

2. A wrench according to claim 1 including a cooperating circumferentially extending internal shoulder and groove between an outer surface of the socket and an inner surface portion of the opening in the body which surrounds the outer surface of the socket to hold the socket in said opening when the fixed and movable portions of the body are in the closed position around the socket.

3. A wrench according to claim 1 including hinge means on the socket enabling a portion of the socket to pivot away from the remaining portion of the socket to enable the socket to move between the open position and the closed position.

4. A gear-operated ratchet wrench comprising:

a body having an opening in it;

an elongated handle secured to the body to rotate the body;

hinge means for rotating the body between an closed position and an open position to expand the effective size of the opening in said body to allow a socket means to be inserted in said opening;

the body having a fixed portion rigidly affixed to the handle and a movable portion engaged with the hinge means to rotate relative to the fixed portion;

means releasably securing the body in said closed position, the releasable securing means comprising a movable locking sleeve having a locked position disposed around the fixed and movable portions of the body to hold the body in said closed position, the sleeve having a released position allowing the movable portion to rotate relative to the fixed portion;

ratchet pawl means carried on said body and extendible into said opening for engagement with a socket means inserted in said opening; and means for reversing the ratchet provided by said ratchet means to provide for reversible undirectional rotation of said socket means relative to the body.

5. A wrench according to claim 4 including spring-biasing means on said sleeve normally biasing the sleeve into said extended position, the sleeve being slidable against the bias of the spring means to said retracted position.

6. A wrench according to claim 4 in which the handle includes a first portion secured to the body and having a free end, and a second portion rotatably attached to the free end of said first portion.

7. A wrench according to claim 6 including means pivotally securing the body of the wrench to the first portion of the handle.

8. A wrench according to claim 6 including means for rotating the second portion of the handle about an axis of the first portion, and spaced apart detent means and cooperating dowel pin means for releasably locking the second portion against rotation in several positions relative to the first portion of the handle.

9. A wrench according to claim 8 including biasing means extending between the first portion of the handle and the second portion thereof for urging the dowel pin means into engagement with the detent means.

10. A wrench according to claim 4 including a cooperating circumferentially extending internal shoulder and groove between an outer surface of the socket and an inner surface portion of the opening in the body which surrounds the socket to hold the socket in said opening when the fixed and movable portions of the body are in the closed position around the socket.

11. A wrench according to claim 4 including hinge means on the socket enabling a portion of the socket to pivot away from the remaining portion of the socket to enable the socket to move between an open position and a closed position.

12. A wrench according to claim 3 including a cooperating circumferentially estending internal shoulder and groove between an outer surface of the socket and an inner surface portion of the opening in the body which surrounds the socket to hold the socket in said opening when the first and second portions of the body are in the closed position around the socket.

13. A wrench according to claim 1 including spring-basing means on said sleeve normally biasing the sleeve into said locked position, the sleeve being slidable against the bias of the spring means to said released position.

14. A wrench according to claim 1 in which the movable portion of the body comprises a single rigid member having a first end pivotally secured to the fixed portion of the body and a second free end which abuts against the fixed portion of the body when said rigid member is in said closed position.

15. A wrench according to claim 14 in which the single movable rigid member is pivotally secured to said fixed portion by a single hinge pin non-removably secured between the fixed portion of the body and said rigid member.

16. A wrench according to claim 4 in which the movable poriton of the body comprises a single rigid member having a first end pivotally secured to the fixed portion of the body and a second free end which abuts against the fixed portion of the body when said rigid member is in said closed position.

17. A wrench according to claim 16 in which the single movable rigid member is pivotally secured to said fixed portion by a single hinge pin non-removably secured between the fixed portion of the body and said rigid member.

18. A gear-operated ratchet wrench comprising:

a body having an opening in it, the opening having an axis of rotation;

socket means for being inserted in said opening for being secured to an object to be rotated by the wrench;

an elongated handle secured to the body for rotating the body about said axis;

the body having a fixed portion rigidly affixed to the handle and a movable portion hinged to the fixed portion for rotating the body between a closed position and an open position to expand the effective size of the opening in the body to allow the socket means to be inserted in the opening, the movable portion of the body being rigid between a first end and a second free end thereof, hinge means pivotally securing the first end of the movable portion to the fixed portion of the body by hinge means for pivoting the second free end of said movable portion relative to said fixed portions;

gear teeth spaced circumferentially around a portion of the socket;

means for releasably locking the second free end of said movable portion to the fixed portion of the body at a location spaced from the hinge means for securing the body in said closed position with the opening of the surrounding the gear teeth portion of the socket, the releasable locking means comprising spring-biased detent means moveble in a plane substantially perpendicular to said axis of rotation for moving into and out of engagement between the movable and fixed portions of the body to alternately lock or release the movable portion against or for movement relative to the fixed portion;

a ratchet pawl for extending into engagement with the gear teeth portion of the socket to allow relative rotation between the socket and the body in one direction of rotation and to prevent said rotation in an opposite direction; and means for moving the ratchet pawl to reverse the direction of relative rotation between the socket and the body.

19. A wrench according to claim 18 in which the fixed portion of the body has a first abutment surface and the movable portion has a second abutment surface which abuts against the first abutment surface when the movable portion is in the closed position; and in which the spring-biased detent means comprises a spring-biased projection extending substantially perpendicularly to one abutment surface for being secured in a recess in the other abutment surface.

20. A wrench according to claim 19 in which the spring-biased projection is movable along an axis substantially parallel to the axis of the handle.

21. A wrench according to claim 18 in which the hinge means comprises a single hinge pin located on a portion of the body on the side of the opening opposite where the handle is secured to the body.

22. A wrench according to claim 18 in which the hinge means comprises a hinge pin which is non-removably secured between the fixed and movable portions of the body.

23. A gear-operated ratchet wrench comprising:

a body having an opening it, the opening having an axis of rotation;

an elongated handle secured to the body to rotate the body about said axis;

the body having a fixed portion rigidly affixed to the handle and a movable portion hinged to the fixed portion for rotating the body between a closed position and an open position to expand the effective size of the opening in the body to allow a socket means to be inserted in said opening, the movable portion of the body being rigid between a first end and a second free end thereof;

hinge means pivotally securing the first end of said movable portion to the fixed portion of the body for pivoting the second free end of said movable portion relative to said fixed portion;

means for releasably locking the second free end of said movable portion to the fixed portion of the body at a location spaced from the hinge means for holding the body in said closed position, the releasable locking means comprising spring-biased detent means movable in a plane substantially perpendicular to said axis of rotation for moving into and out of engagement between the movable and fixed portions of the body to alternately lock or release the movable portion against or for movement relative to the fixed portion; and ratchet means extendible into said opening for engagement with a socket means inserted in said opening for providing reversible unidirectional rotation of such a socket means relative to the body.

24. A wrench according to claim 23 in which the fixed portion of the body has a first abutment surface and the movable portion has a second abutment surface which abuts against the first abutment surface when the movable portion is in the closed position; and in which the spring-biased detent means comprises a spring-biased projection extending substantially perpendicular to one abutment surface for being received in a recess in the other abutment surface.

25. A wrench according to claim 24 in which the spring-biased projection is movable along an axis substantially parallel to the axis of the handle.

26. A wrench according to claim 23 in which the hinge means comprises a single hinge pin located on a portion of the body on the side of the opening opposite where the handle is secured to the body.

27. A wrench according to claim 23 in which the hinge means comprises a hinge pin which is non-removably secured between the fixed and movable portions of the body.

* * * * *

UNITED STATES PATENT AND TRADEMARK OFFICE

CERTIFICATE OF CORRECTION

PATENT NO. : 4,095,494

DATED : June 20, 1978

INVENTOR(S) : JOHN H. CASTOE

It is certified that error appears in the above-identified patent and that said Letters Patent are hereby corrected as shown below:

Col. 6, line 54, "189" should read -- 180 --.

Col. 9, line 29, "an" should read -- a --.

Signed and Sealed this

Sixth Day of March 1979

[SEAL]

*Attest:*

RUTH C. MASON
*Attesting Officer*

DONALD W. BANNER
*Commissioner of Patents and Trademarks*